United States Patent [19]

Morrow

[11] 4,052,941

[45] Oct. 11, 1977

[54] PRODUCTION OF ELECTROLESS METAL COATINGS ON NITROCELLULOSE BASE PROPELLANTS AND ARTICLE

[75] Inventor: Scott I. Morrow, Denville, N.J.

[73] Assignee: The United States of America as represented by the Secretary of the Army, Washington, D.C.

[21] Appl. No.: 689,288

[22] Filed: May 24, 1976

[51] Int. Cl.[2] ..... C23C 3/02

[52] U.S. Cl. ..... 102/39; 102/DIG. 1; 427/304; 427/306; 428/464

[58] Field of Search ..... 427/304, 305, 306, 170; 102/39, 28 R, DIG. 1, 103; 106/166; 149/76, 79; 428/464

[56] References Cited

U.S. PATENT DOCUMENTS

| | | | |
|---|---|---|---|
| 1,984,846 | 12/1934 | Spaeth | 149/79 |
| 2,007,223 | 7/1935 | Spaeth | 149/79 |
| 3,299,812 | 1/1967 | Suh et al. | 102/39 |
| 3,328,217 | 6/1967 | Ferugson | 149/79 |
| 3,897,285 | 7/1975 | Hamilton et al. | 102/39 |

*Primary Examiner*—Ralph S. Kendall

*Attorney, Agent, or Firm*—Nathan Edelberg; A. Victor Erkkila; Harold H. Card, Jr.

[57] ABSTRACT

Electroless metal coatings of increased adhesion are obtained on nitrocellulose base explosive films, grains, etc., by incorporating ammonium perchlorate in the nitrocellulose explosive substrate to be electrolessly coated with the metal.

12 Claims, No Drawings

PRODUCTION OF ELECTROLESS METAL COATINGS ON NITROCELLULOSE BASE PROPELLANTS AND ARTICLE

GOVERNMENTAL INTEREST

The invention described herein may be manufactured, used, and licensed by or for the Government for Governmental purposes without the payment to me of any royalties thereon.

BACKGROUND OF THE INVENTION

U.S. Pat. No. 3,299,812 relates to ammunition for stud drivers, rifles and the like, which includes an electric ignition cartridge comprising a pellet of a deflagrating explosive, e.g. a double based smokeless powder grain, containing nitrocellulose and nitroglycerin, plated with a thin metal coating, which is heated by the passage of an electric current to a temperature sufficient to ignite the adjacent surface portion of the explosive.

A principal problem in the production of a resistance electrical ignition system (REIS) of the aforesaid type utilizing a metal plated film or grain of a nitrocellulose base deflagrating explosive, hereinafter referred to as propellant, is that the nitrocellulose because of its smooth surface does not plate well with conventional commercial electroless plating reagents. For this reason, it is difficult to obtain a metal coating, which possesses good adhesion to the nitrocellulose substrate and resistance to electrical breakdown, a common troublesome factor in attempts to ignite the nitrocellulose propellant by means of an electrical current. This tendency to electrical breakdown is a major obstacle in developing REIS igniters, which ignite with sufficient speed by application of an electric current so as to be suitable for use in fast acting propellant devices, such as cannon, rockets, pyrotechnic devices, etc. Speed of ignition is related among other things to voltage of the DC power supply used to ignite the REIS device. However, as the DC voltage is increased to reduce the ignition delay with electrolessly deposited copper or other metal films on nitrocellulose substrates, there is a tendency for the metal film to rupture, which results in loss of its ability to further carry any current.

One method for providing a fairly satisfactory surface for electroless plating of metals is to roughen the nitrocellulose propellant substrate mechanically with fine emery cloth, ground glass, grinding powder, etc. It is thought that the roughened surface enables the palladium or other catalyst conventionally employed to be deposited more effectively, thereby promoting adherence of the electrolessly plated metal coating. However, from the standpoint of mass production of such metal plated nitrocellulose base REIS igniters, surface conditioning by mechanical pretreatment is objectionable, since it requires special equipment, extended process time or at least considerable hand labor and hence involves expensive operations.

SUMMARY AND DETAILED DESCRIPTION OF THE INVENTION

An object of the present invention is to provide a method for producing electrolessly deposited metal coatings on nitrocellulose base propellants, which possess improved adhesion without the need for costly, time-consuming roughening of the nitrocellulose propellant substrate prior to plating with the metal.

Another object is to provide a nitrocellulose propellant having an improved surface for electroless deposition of metals thereon.

A further object is to provide a method adapted for mass production of metal coated nitrocellulose based REIS igniters, which can be readily ignited by the application of low voltage DC current, can easily ignite a propellant charge and leave negligible residue in the mechanism of a gun, such as a cannon.

Other objects will become apparent as the invention is further described.

It has now been unexpectedly found that the foregoing objects can be achieved by incorporating particulate ammonium perchlorate in the nitrocellulose propellant substrate and coating the thus conditioned substrate with an electrically conductive metal, such as copper, by electroless plating methods. The presence of the ammonium perchlorate is additionally beneficial in that it promotes the rapid ignition of the metal coated nitrocellulose propellant film or grain by means of a low voltage DC current.

The particulate ammonium perchlorate can be incorporated in the nitrocellulose propellant substrate in any suitable manner, for example, by dissolving the ammonium perchlorate and the nitrocellulose in a mutual solvent, e.g. acetone, and removing the solvent from the resulting solution by evaporation, whereby the ammonium perchlorate is precipated and uniformly distributed in particulate, i.e. finely divided form throughout the nitrocellulose. A preferred method comprises suspending the particles of ammonium perchlorate in a solution of the nitrocellulose in a solvent, including a mixture of solvents, which may or may not be a mutual solvent for both the ammonium perchlorate and the nitrocellulose, and partially removing the solvent until a doughy mass is produced and working the mass in a heated mixer or on heated steel rolls to evaporate the solvent and consolidate the mixture into a homogeneous composition, containing a uniform dispersion of the ammonium perchlorate particles in the nitrocellulose propellant, which can be extruded or pressed into grains, pellets, etc. The ammonium perchlorate is employed preferably as finely divided particles not exceeding 100 microns and preferably 50 microns or less in average maximum dimension, when it is insoluble in the solvents employed to dissolve the nitrocellulose.

The nitrocellulose propellant substrates which can be conditioned with ammonium perchlorate according to the present invention include single and double base propellants, which contain from 50 to 100% by weight of nitrocellulose having a nitrogen content between 12 and 14.14%. Such propellants can also contain other ingredients, e.g. 0 to 5% by weight of stabilizers for the nitrocellulose, e.g. diphenylamine, 2-nitrodiphenylamine, and sym-diethyldiphenylurea; 0 to 50% by weight of plasticizers including nitrate type plasticizers, e.g. nitroglycerin, diethyleneglycol dinitrate, triethylene glycol dinitrate, metriol trinitrate and 1,2,3- and 1,3,4-butanetriol trinitrates, and/or fuel type plasticizers, e.g. triacetin, and the dimethyl, diethyl, dibutyl and di(2-ethylheyl) esters of o-phthalic, adipic and sebacic acids; and 0–10% by weight of crystalline nitramine explosives, e.g. cyclotrimethyletrinitramine (RDX) and cyclotetramethylenetetranitramine (HMX).

The ammonium perchlorate is incorporated in the nitrocellulose explosive substrate in an amount effective to increase the adhesion of the metal coating produced. The amount of ammonium perchlorate thus incorporated is preferably at least 1% and particularly between about 5% and 25% by weight based on the nitrocellulose content of the propellant substrate. Amounts of ammonium perchlorate substantially greater than 50% by weight, while effective, are generally less desirable, since they tend to have an adverse affect on the structural integrity of the nitrocellulose explosive substrate.

Qualitatively similar results can be obtained by replacing part or all of the ammonium perchlorate with a mixed salt of ammonium perchlorate and an alkali metal perchlorate described in my U.S. Pat No. 3,208,357.

The present invention can be employed with electrolessly platable metals other than copper, such as for example, nickel, silver, tin, gold, cobalt and palladium, to increase the adhesion of the metal coating produced on nitrocellulose propellant substrates, e.g. films and grains. Various electroless methods for plating metals are known in the art and can be utilized, as appropriate. Further, the electrolessly platable methods can be coated on diverse physical forms or shapes of the ammonium perchlorate-conditioned nitrocellulose propellant substrates, including films, sheets, pellets, grains, bars, discs, etc., which may vary widely in thickness.

The following examples provide further specific illustrations of the method of carrying out the process of the present invention.

EXAMPLE 1

1.439 grams of dry ammonium perchlorate, pulverized to pass through a 44 micron size opening sieve, were stirred into 50cc of acetone. The resulting mixture, containing some undissolved ammonium perchlorate, was mixed with 50cc of a solution consisting of 1.5 grams of nitrocellulose (12.6%N) in acetone, whereupon the ammonium perchlorate was completely dissolved. 50cc of acetone containing 32.8 milligrams of diphenylamine stabilizer were then added with agitation. The resulting solution was poured into a 15.3 × 24.3 cm rectangular glass tray having a frosted glass bottom and the acetone was removed by evaporation with a stream of nitrogen. The nitrocellulose film thus obtained was peeled from the tray and then allowed to age at room temperature before plating.

The film was then plated directly without any abrading pretreatment with electroless copper plating reagents at room temperature by immersing the film successively in the following baths sold by the Shipley Company, Newton, Mass:

1. Cuposit ® Conditioner 1160, 1 minute
2. Cuposit ® Catalyst 9F, 3 minutes
3. Cuposit ® Accelerator 19, 3 minutes
4. Cuposit ® PM-990 Electroless Copper, 6 minutes (Baths 2 and 3 are disclosed in U.S. Pat. No. 3,011,920; bath 4 is disclosed in U.S. Pat. No. 3,846,138). The film was thoroughly rinsed with distilled water after each bath and the copper plated film thus obtained was air dried and examined. The copper coating possessed good adhesion and cohesion on both sides of the film. Microscopic examination showed that on the smooth (up-as-cast) side of the film, i.e. the side opposite to the microscopically rough side obtained in contact with the frosted glass during casting, there were two types of ammonium perchlorate growths: The first type was characterized by microscopic, dendritic, leaf-like growths located within the nitrocellulose film, while the second type consisted of relatively large star-shaped crystals, which projected above the plane of the film like sparkling gems. The copper coating possessed discontinuities or vacant spots on the sites of the larger star-shaped ammonium perchlorate crystals; and it appeared that in such sites the ammonium perchlorate crystals were covered by a thin film of nitrocellulose, which inhibited to a significant degree removal thereof by leaching in the treatment baths.

A control film of nitrocellulose was prepared and copper plated in the same manner as described above except that the ammonium perchlorate was omitted. An unsatisfactory copper plate was thus obtained on the smooth side of the film, i.e. the copper plate adhered poorly and showed poor resistance to electrical breakdown. The copper plate obtained on the roughened side of the film possessed fairly satisfactory adhesion. By subjecting the smooth side of the film as cast to an abrading pretreatment by hand with fine emery cloth, a copper plate possessing fairly good adhesion and resistance to electrical breakdown could be obtained; but it was time consuming and more difficult to achieve a satisfactory copper plate thereby than when ammonium perchlorate was present.

The REIS properties of the copper coated nitrocellulose film were tested as follows:

The copper plated nitrocellulose film containing the ammonium perchlorate additive obtained as described above was cut into strips 0.7 cm wide and 4.5 cm long. The electrical resistances of the strips were measured with a standard metering apparatus and the ignition characteristics thereof were determined in air at atmospheric pressure in a closed bomb having an effective volume of 116 cc. One strip, having a resistance of 2.5 ohms on the smooth side and 2.1 ohms on the rough side and weighing 13.14 mg, had a resistance of 0.8 ohm installed in the bomb. It ignited within 40 milliseconds at 13 volts of DC current, generating a pressure of about 6 psig. within 0.12 second in the bomb. A second strip with resistances of 2.5 ohms and 2.0 ohms on the sides, weighed 13.56 mg and had a resistance of 0.9 ohm installed in the bomb. It ignited within 15 milliseconds at 18 volts DC, generating the following pressures: 0.3 psig. in 20 milliseconds; 0.9 psig. in 40 milliseconds; maximum pressure 5.5 psig. in 0.2 seconds.

In another test with copper plated nitrocellulose film containing ammonium perchlorate obtained in a manner similar to that described above, the film was cut into 0.7 by 4.5 cm strips and the electrical resistances thereof were determined as follows:

| Film | Weight mg | Resistance (Smooth Side) | Resistance (Rough Side) |
|---|---|---|---|
| 1 | 14.06 | 0.8 ohm | 0.8 ohm |
| 2 | 13.55 | 0.8 ohm | 1.4 ohms |
| 3 | 14.43 | 1.0 ohm | 0.8 ohm |
| 4 | 13.40 | — | 1.2 ohms |

These four strips were then stacked with the same sides up into a bundle and held tightly together in the middle with ⅛ in. wide scotch tape. A length of ⅛ in. wide aluminum foil was then interwoven at both ends of the film strips so as to produce electrical contact with all eight copper coatings (two per film strip). The resulting REIS igniter element was placed in a bomb having an effective volume of 116 cc. The total resistance of the REIS element measured after the bomb was closed was 0.4 ohm. When a 20 volt DC current was applied to the aluminum terminals, a fast pressure rise to deflagration of the film bundle occurred in 30 milliseconds and a maximum pressure of 25 psig. was developed in 80 milliseconds. Thus, the actual burning time was 50 milliseconds.

A bundle of 6 strips of copper plated nitrocellulose film containing ammonium perchlorate additive obtained and arranged in a REIS igniter structure as described above, was placed in a bomb having an effective volume of 116 cc. The bundle weighed 81.36 milligrams and possessed a resistance of 0.5 ohm installed in the bomb. A bundle of films of M8 propellant* weighing 0.56 gram was wrapped around the REIS igniter. When the igniter was fired by application of 30 volts DC current in air at atmospheric pressure in the closed bomb, ignition occurred within 30 milliseconds with generation of 36 psig. pressure within 75 milliseconds. The M8 propellant was completely consumed. The test showed that the REIS igniter is capable of igniting propellants commonly employed in mortars, cannon and the like.

*8 propellant has the following composition - percentages are by weight:

nitrocellulose (13.25%N): 52.15%
nitroglycerin: 43.00%
potassium nitrate: 1.25%
diethyl phthalate: 3.00%
ethyl centralite: 0.6%

EXAMPLE 2

The procedure of Example 1 was repeated except that the nitrocellulose film was immersed in the electroless copper plating bath for 40 minutes instead of the usual 5 minutes. Microscopic examination showed that there were vacant spots in the copper film where the larger particles of ammonium perchlorate had been located in the surface of the nitrocellulose film but had been leached out. A 0.7 by 4.5 cm strip of the resulting film, having a resistance of 1 ohm on the smooth side and 0.3 ohm on the rough side and weighing 17. 27 mg, ignited within 30 milliseconds at 14 volts DC current in a closed bomb of 116 cc effective volume at one atmosphere. A maximum pressure of 3.5 psig. was generated in the bomb within 0.1 second.

This example shows that even though ammonium perchlorate additive may be lost to some extent by prolonged treatment conditions during the electroless plating process, the metal coated nitrocellulose film obtained still retains desirable REIS characteristics. (It is believed that the vacant spots in the copper plating may actually constitute an advantage in that they provide a means for the nitrocellulose to start burning without being inhibited by the coating. In any case such copper plated nitrocellulose films possess characteristics which are highly desirable for REIS purposes).

The foregoing disclosure is merely illustrative of the principles of this invention and is not to be interpreted in a limiting sense. I wish it to be understood that I do not desire to be limited to the exact details of construction shown and described, because obvious modifications will occur to a person skilled in the art.

What is claimed is:

1. In a method for producing a metal coating on a nitrocellulose base propellant substrate, wherein the metal is deposited on the nitrocellulose substrate from an electroless metal plating bath, the improvement which comprises incorporating in the nitrocellulose substrate to be coated an effective amount of a particulate ammonium perchlorate to increase the adhesion of the metal coating produced.

2. The method of claim 1, wherein the amount of the ammonium perchlorate is between 1% and about 50% based on the weight of the nitrocellulose content of the propellant substrate.

3. The method of claim 1, wherein the ammonium perchlorate is incorporated by dissolving the nitrocellulose and the ammonium perchlorate in a mutual solvent and removing the solvent from the solution.

4. The method of claim 3, wherein the solvent is acetone.

5. The method of claim 1, wherein the nitrocellulose contains between about 12% and 14.14% nitrogen.

6. The method of claim 1, wherein the amount of the ammonium perchlorate is between about 5% and 25% based on the weight of the nitrocellulose content of the propellant substrate.

7. The method of claim 1, wherein the metal is copper.

8. The method of claim 1, wherein the nitrocellulose substrate is in the form of a film or sheet.

9. A method of conditioning a nitrocellulose base propellant substrate to increase the adhesion of an electrolessly deposited metal coating thereon, which comprises incorporating in the nitrocellulose substrate to be coated an effective amount therefor of a particulate ammonium perchlorate.

10. The method of claim 9, wherein the amount of the ammonium perchlorate is between 1% and 50% by weight of the nitrocellulose content of the substrate.

11. The conditioned product obtained by the process of claim 9.

12. The conditioned product obtained by the process of claim 10.

* * * * *